US010568393B2

(12) United States Patent
Moran

(10) Patent No.: US 10,568,393 B2
(45) Date of Patent: Feb. 25, 2020

(54) LOCKING MECHANISM WITH MULTIPLE STAGE LOCKING VERIFICATION

(71) Applicant: Control Dynamics, Inc., Everett, WA (US)

(72) Inventor: Eric Moran, Camano Island, WA (US)

(73) Assignee: Control Dynamics, Inc., Everett, WA (US)

( * ) Notice: Subject to any disclaimer, the term of this patent is extended or adjusted under 35 U.S.C. 154(b) by 115 days.

(21) Appl. No.: 15/584,882

(22) Filed: May 2, 2017

(65) Prior Publication Data

US 2017/0332742 A1 Nov. 23, 2017

Related U.S. Application Data

(63) Continuation-in-part of application No. 15/065,582, filed on Mar. 9, 2016, now Pat. No. 10,238,184.
(Continued)

(51) Int. Cl.
*A44B 11/25* (2006.01)
*A62B 35/00* (2006.01)

(52) U.S. Cl.
CPC ..... *A44B 11/2573* (2013.01); *A44B 11/253* (2013.01); *A44B 11/2519* (2013.01);
(Continued)

(58) Field of Classification Search
CPC ..... A44B 11/2519; A44B 11/2573; A44B 11/263; A44B 11/2569; A44B 11/266; A44B 11/253; A44B 11/2511; A44B 11/26; A44B 17/0005; A44B 17/0041; A44B 17/0076; A44B 35/00; B64D 25/06; A62B 35/006; A62B 35/0025; A62B 35/0037;
(Continued)

(56) References Cited

U.S. PATENT DOCUMENTS 2,903,774 A 9/1959 Harley
3,090,092 A 5/1963 Szemplak et al.
(Continued)

OTHER PUBLICATIONS

European Patent Office; Extended European Search Report dated Nov. 23, 2018; EP Application No. 16818381.2; pp. 1-8.
(Continued)

*Primary Examiner* — Jack W Lavinder
(74) *Attorney, Agent, or Firm* — FisherBroyles LLP; Kevin D. Jablonski

(57) ABSTRACT

A system and method for a locking mechanism that includes an ability to indicate proper engagement via a signal cable coupled through a harness. The locking mechanism may include electronic components including three magnetic actuators and corresponding electronic switches that signal change of state. Locking tabs and a leading edge of the insert respectively include the three magnetic actuators. The electronic switches, which may be magnetically activated reed switches, signal status change to an external controller and, optionally, an external computer. Further, status signals and power signals may be routed through a steel cable or woven nylon harness that coupled the locking mechanism to a local anchor point. Change of status notification may be important on critical safety worksites where lack of mechanical and electronic connection can be life threatening.

19 Claims, 19 Drawing Sheets

Related U.S. Application Data

(60) Provisional application No. 62/186,557, filed on Jun. 30, 2015.

(52) U.S. Cl.
CPC ..... *A44B 11/2561* (2013.01); *A44B 11/2569* (2013.01); *A62B 35/0025* (2013.01)

(58) Field of Classification Search
CPC ..... A62B 35/0043; A62B 35/0056; A62B 35/0062; A62B 35/0075; A62B 35/00; G08B 21/02; G08B 21/0288; G01W 1/02; G06K 19/0717; E06C 7/003; B60R 21/01516
USPC ..... 297/468; 175/219; 340/687, 686.4, 673, 340/679, 685
See application file for complete search history.

(56) References Cited

U.S. PATENT DOCUMENTS 3,644,967 A 2/1972 Romanzi, Jr. et al.
5,033,171 A 7/1991 Kasai
5,144,725 A 9/1992 Krauss
5,383,257 A 1/1995 Krauss
5,548,879 A 8/1996 Wu
5,556,415 A 9/1996 McEwen et al.
6,265,983 B1 * 7/2001 Baillargeon ..... A62B 35/0037 340/673
6,668,434 B2 12/2003 Casebolt et al.
6,965,231 B1 11/2005 Cinoglu et al.
7,077,372 B2 7/2006 Moran
7,114,225 B2 10/2006 Casebolt et al.
7,261,264 B2 8/2007 Moran
7,275,613 B2 10/2007 Park
7,375,517 B1 5/2008 Cinoglu et al.
7,726,706 B2 6/2010 Moran
7,902,960 B2 3/2011 Tsuchimochi et al.
8,240,012 B2 8/2012 Walega et al.
9,238,573 B2 * 1/2016 Luminet ..... A42B 3/046
9,402,447 B2 8/2016 Hortnagl
9,578,929 B2 2/2017 Hung
2002/0145515 A1 * 10/2002 Snowbarger ..... G05B 9/02 340/514
2002/0170783 A1 11/2002 Goode
2002/0184742 A1 12/2002 Casebolt et al.
2004/0227626 A1 11/2004 Almaraz et al.
2006/0048350 A1 * 3/2006 Coulombe ..... A44B 11/253 24/634
2006/0222287 A1 * 10/2006 Gulvin ..... G02B 6/3508 385/16
2009/0078501 A1 3/2009 Mordecai et al.
2009/0243892 A1 10/2009 Cheung
2010/0013622 A1 * 1/2010 Rumps ..... A44B 11/2565 340/457.1
2010/0026025 A1 2/2010 McKay
2010/0101060 A1 4/2010 Walega et al.
2010/0243373 A1 * 9/2010 Johnson ..... A44B 11/253 182/3
2011/0162177 A1 * 7/2011 Von Der Ahe ..... A44B 11/2519 24/641
2011/0239413 A1 * 10/2011 Milbright ..... A44B 11/253 24/191
2012/0124790 A1 5/2012 Richards et al.
2013/0199854 A1 * 8/2013 Bagnaro ..... A62B 35/0025 175/219
2014/0067668 A1 * 3/2014 Bellamy ..... G07F 19/207 705/43
2014/0251725 A1 9/2014 Schurian et al.
2014/0298630 A1 * 10/2014 Hortnagl ..... A44B 11/2592 24/697.2
2015/0074958 A1 3/2015 Hung
2015/0089777 A1 4/2015 Hung
2017/0000219 A1 1/2017 Moran

OTHER PUBLICATIONS

International Searching Authority of WIPO; International Search Report & Written Opinion dated Jul. 27, 2018; PCT Appl No. PCT/US2018/030703; pp. 1-15.
ISO/WO for PCT/US16/028985, dated Jul. 14, 2016; pp. 1-11.
DB Industries, Inc.; DBI Sala Manual, "DBI Sala Exofit", pp. 1-32.
Guardian Fall Protection, Instruction Manual, "Velocity SRL", pp. 107.

* cited by examiner

LOCKING MECHANISM WITH MULTIPLE STAGE LOCKING VERIFICATION

PRIORITY CLAIM TO RELATED APPLICATIONS

The present application claims priority and benefit from U.S. patent application Ser. No. 15/065,582, filed Mar. 9, 2016 and titled, "LOCKING MECHANISM WITH ONE AND TWO-STAGE LOCKING VERIFICATION" which, in turn, claims priority and benefit from U.S. provisional patent application Ser. No. 62/186,557, filed on Jun. 30, 2015, and titled and titled, "LOCKING MECHANISM WITH ONE AND TWO-STAGE LOCKING VERIFICATION". The entire content of the parent application and the provisional application is herein expressly incorporated by reference.

TECHNICAL FIELD

The subject matter pertains to locking mechanisms that have one and two-stage locking verification capabilities through mechanical and electro-mechanical means with two and three point unlocking means.

BACKGROUND

A need exists for an improved locking mechanism, particularly with a two-stage locking verification for dangerous applications such as releasing a worker strapped into a safety harness from a lifeline. Current known connectors can easily be bypassed.

SUMMARY

The subject matter is directed to an improved locking mechanism that has mechanical (one stage) and electro/mechanical (two stage) locking verification. Further, among various embodiments, two and three point unlocking means are included.

The mechanical aspects include a receiver base, a pair of locking tabs, and an insert. Each locking tab has a first arm and a second arm where each arm is connected at a pivot point. Each locking tab is configured to pivot about the pivot point that is operatively connected to an upper portion of the receiver base in a spaced apart fashion to form a cavity between the receiver base and the locking tabs.

A lower portion of the receiver base is configured to be operably engageable with a first device. A lower portion of the insert is configured to be received within a cavity and retained by at least the first arms of the locking tabs. An upper portion of the insert is configured to be operably engageable with a second device. The lower portion of the insert is retained by the receiver base and locking tabs. To disengage, both locking tabs must be rotated to dislodge the insert. Such disengagement is the two paint mechanical unlocking method.

Another aspect includes a push button assembly that has a retractable lip that is configured to engage with the receiver base and retains the second arms from the locking tabs from movement. Here, the push button would need to be depressed and retract the lip from the receiver base and from the two second arms at the same time a force is applied to the locking tabs to rotate the arms of each locking tab to disengage the insert from the cavity. Such disengagement described herein is the three point mechanical unlocking method.

The subject matter may further include electronic components including three magnetic actuators and corresponding electronic switches that signal change of state. The two second arms of the locking tabs and a leading edge of the insert respectively include the three magnetic actuators. The electronic switches, which may be magnetically activated reed switches, signal status change to an external controller and, optionally, an external computer. Further, status signals and power signals may be routed through a steel cable or woven nylon harness that coupled the locking mechanism to a local anchor point. Change of status notification may be important on critical safety worksites where lack of mechanical and electronic connection can be life threatening.

These and other advantages will become more apparent upon review of the Drawings, the Detailed Description, and the Claims.

BRIEF DESCRIPTION OF THE DRAWINGS

Like reference numerals are used to designate like parts throughout the several view of the drawings, wherein.

DETAILED DESCRIPTION

Figure 1:
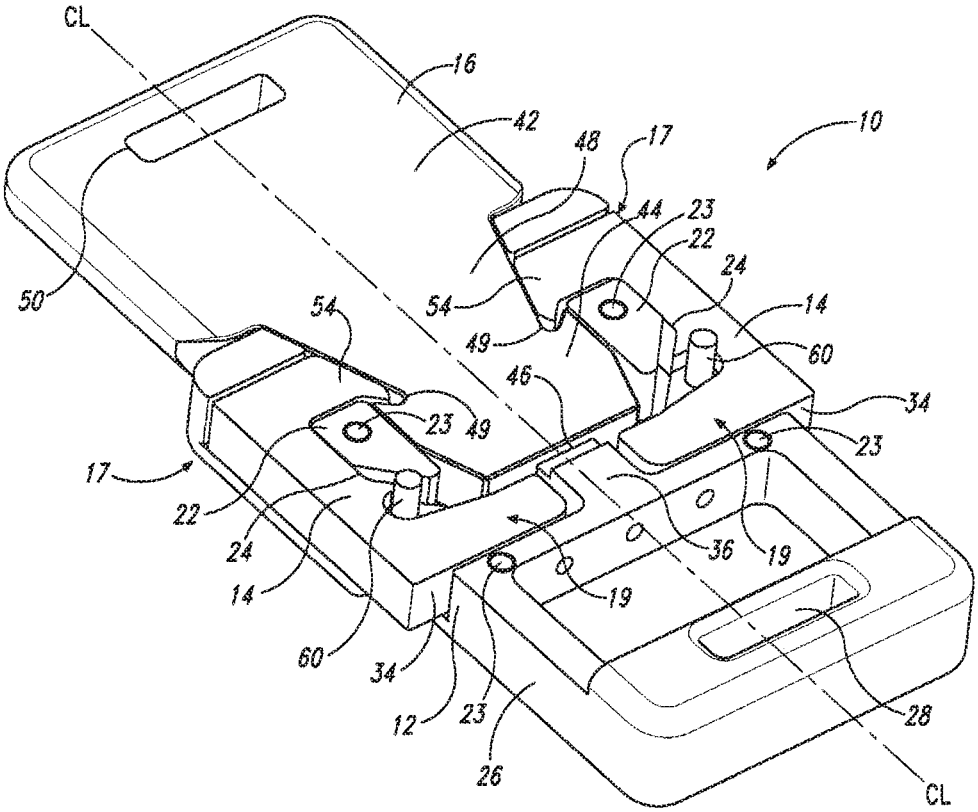
FIG. 1 is a front perspective view of an assembled locking mechanism disclosing a receiver base, a pair of pivotable locking tabs about respective cylindrical posts, and an insert (illustrated without a cover) according to an embodiment of the subject matter disclosed herein.

Referring to FIGS. 1-11 and 16, locking mechanism 10 brings two devices together and maintains the connection until such time the connection is intentionally broken. Locking mechanism 10 includes a receiver base 12, a pair of pivotable locking tabs 14, and an insert 16 of which a portion is received within a cavity 18 of receiver base 12 and held in place by locking tabs 14. An optional cover 20 (FIGS. 6, 10) may cover the majority of receiver base 12 and the majority of locking tabs 14 through fasteners 21 received into apertures 23 (such as those illustrated) or other commonly known fastener means.

Receiver base 12 includes two spaced-apart and outwardly-projecting chocks 22 that conform to the shape of an interior surface 24 of locking tabs 14 and further define the boundaries of the cavity 18 in which a portion of insert 16 is received. Receiver base 12 also includes a lower section 26 that is configured to engage a first device. According to one embodiment, lower section 26 contains an opening 28. The opening may be an elongated slot (as illustrated in FIGS. 1-3 and 5) to accommodate a safety strap 30 (see FIG. 2 for example) that is operatively connected to a first device, such as a safety harness for example. Opening 28 may be aligned below cavity 18 relative to centerline CL of receiver base 12.

Receiver base 12 may also include a generally central ledge 32 to which bottom portions 34 of the locking tabs rest against when in the locked position. Receiver base 12 may also include an optional central abutment member 36 to which a portion of insert 16 abuts when the insert is fully engaged and in the locked position relative to the receiver base and engaged by the locking tabs (as illustrated in FIG. 1).

Figure 7:
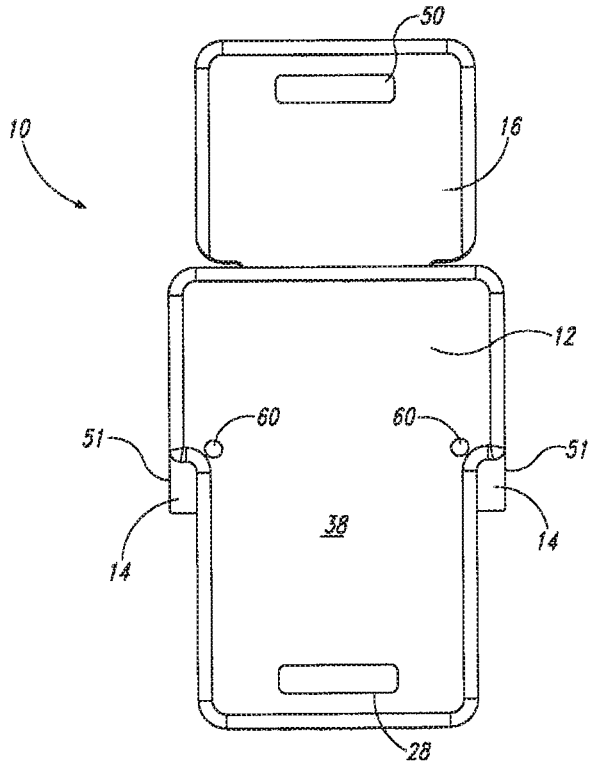
FIG. 7 is a back view of the assembled locking mechanism of FIG. 1 according to an embodiment of the subject matter disclosed herein.
Figure 8:
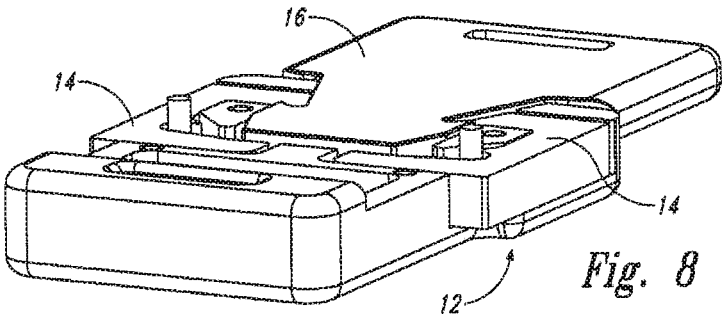
FIG. 8 is a rear perspective view of the assembled receiver base, locking tabs, and insert member according to an embodiment of the subject matter disclosed herein.
Figure 9:
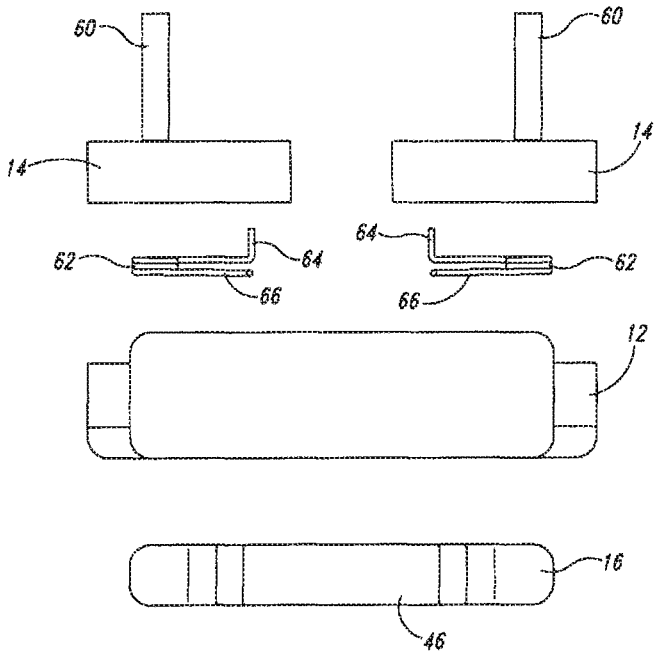
FIG. 9 is an exploded rear view of the receiver base, the insert, and the locking tabs and the cylindrical posts of FIG. 1 according to an embodiment of the subject matter disclosed herein.
Figure 11:
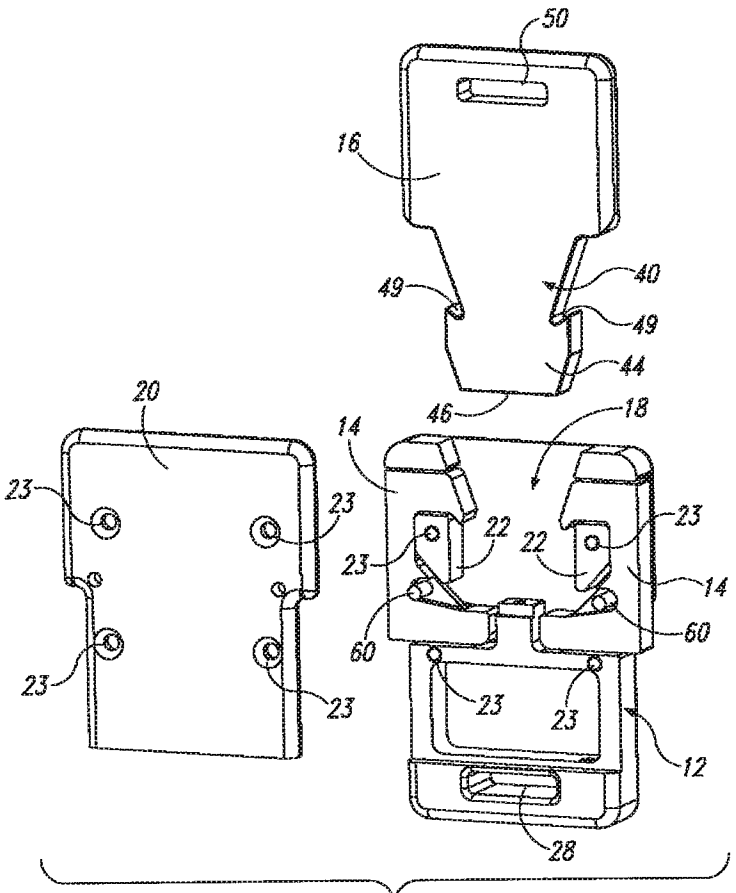
FIG. 11 is an exploded front perspective view of the locking assembly of FIG. 10 according to an embodiment of the subject matter disclosed herein.
Figure 10:
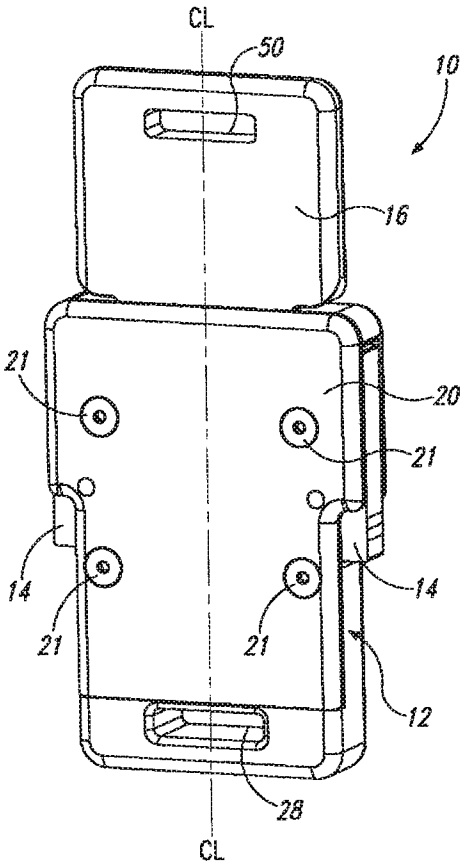
FIG. 10 is a front perspective view of the locking assembly with the cover placed over the receiver base and the locking tabs according to an embodiment of the subject matter disclosed herein.
Figure 12:
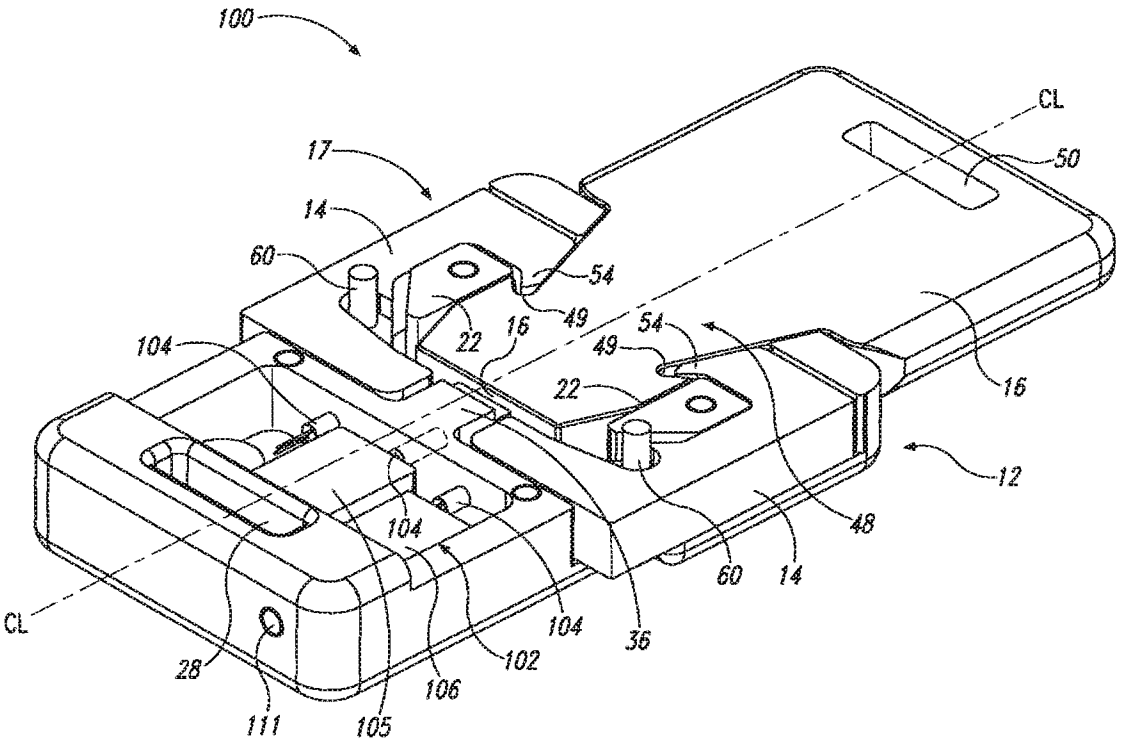
FIG. 12 is an assembled front perspective view of an alternate embodiment of the locking mechanism illustrating a receiver base, a pair of pivoting locking tabs, an insert, and an electronic bay with electronic components to provide a second stage of locking the locking mechanism (illustrated without a cover) according to an embodiment of the subject matter disclosed herein.

According to one aspect of one embodiment, receiver base 12 has a planar back surface 38 (see FIG. 7). In one form, cover 20 also includes a smooth planar exterior surface 40 (see FIG. 6). When the cover is assembled onto the receiver base 12, the two major surface of the assembled locking mechanism are smooth, planar, and parallel to each other (see for example FIGS. 10 and 16).

Insert 16 may be in the form of a solid planar slab 42 having a lower portion that includes an external "key like" projection 44 having a leading edge 46. Between projection 44 and an upper portion is a transition section 48 that forms a pocket 49 on each side of transition section 48. In one form, the transition and the "key like" projection are received into cavity 18 of receiver base 12 along centerline CL when the insert is inserted into the receiver base in order to lock the locking mechanism. In the fully locked position, end surface 46 abuts the center ledge of the receiver base, or, alternatively, the central abutment member 36 as illustrated in FIG. 1. Opposite end surface 46 within slab 42 is an opening 50 that engages an object, such as a safety strap like safety strap 30. Opening 50 may be an elongated slot similar to opening 28 within receiver base 12.

Insert 16 is configured to be centerline-received into cavity 18 with "key like" projection 44 and at least part of transition section 48 being able to be inserted within cavity 18 formed by receiver base 12, locking tabs 14, and chocks 22. In one form, leading edge 46 abuts central ledge 32 or central abutment 36. Opening 50 within insert 16 is aligned above opening 28 of the lower portion of receiver base 12.

Locking tab 14 may be of various shapes. The locking tabs each have a first arm 17 and a second arm 19 extending outwardly from a central point (the pivot point) where the first arm, second arm and pivot may form a general "L" shape. The first arm engages the lower portion of the insert, i.e., the "key like" projection and at least a portion of transition section 48. According to one embodiment, each locking tab has a top portion 52 that may be configured with a hook nose 54, a side portion 56, and bottom portion 34 (already introduced above). Each locking mechanism has an exterior surface 51 adjacent the pivot point. Top portion 52, side portion 56, and bottom portion 34 form an elongated "c-shaped" cavity 58 that corresponds to the shape of chock 22. In one form, the locking tabs' outer surfaces (defined by the top portion, side portion, and bottom portion) have generally straight surfaces so that the exterior appears to be a partial rectangle. The second arm of each locking tab includes an upper surface 59 that is configured to contact leading edge 46 of insert 16 during unlocking. The second arm further includes a lower surface 61 that may rest on central ledge 32 of receiver base 12 when the locking mechanism is locked.

A cylindrical post 60 is inserted axially through bottom portion 34 and operatively connected to receiver base 12 (such as press fit connected into a tapped and threaded hole (see FIG. 3) or through other standard fastening means well known in the industry). In this way, bottom portion 34, side portion 56, and top portion 52 with nose 54 pivot about cylinder post 60 and are rotationally limited by its corresponding chock 22 and central ledge 32, as well as engagement with pocket 49 by nose 54 when insert projection 44 and at least a portion of the insert transition section 48 is inserted into cavity 18.

Figure 2:
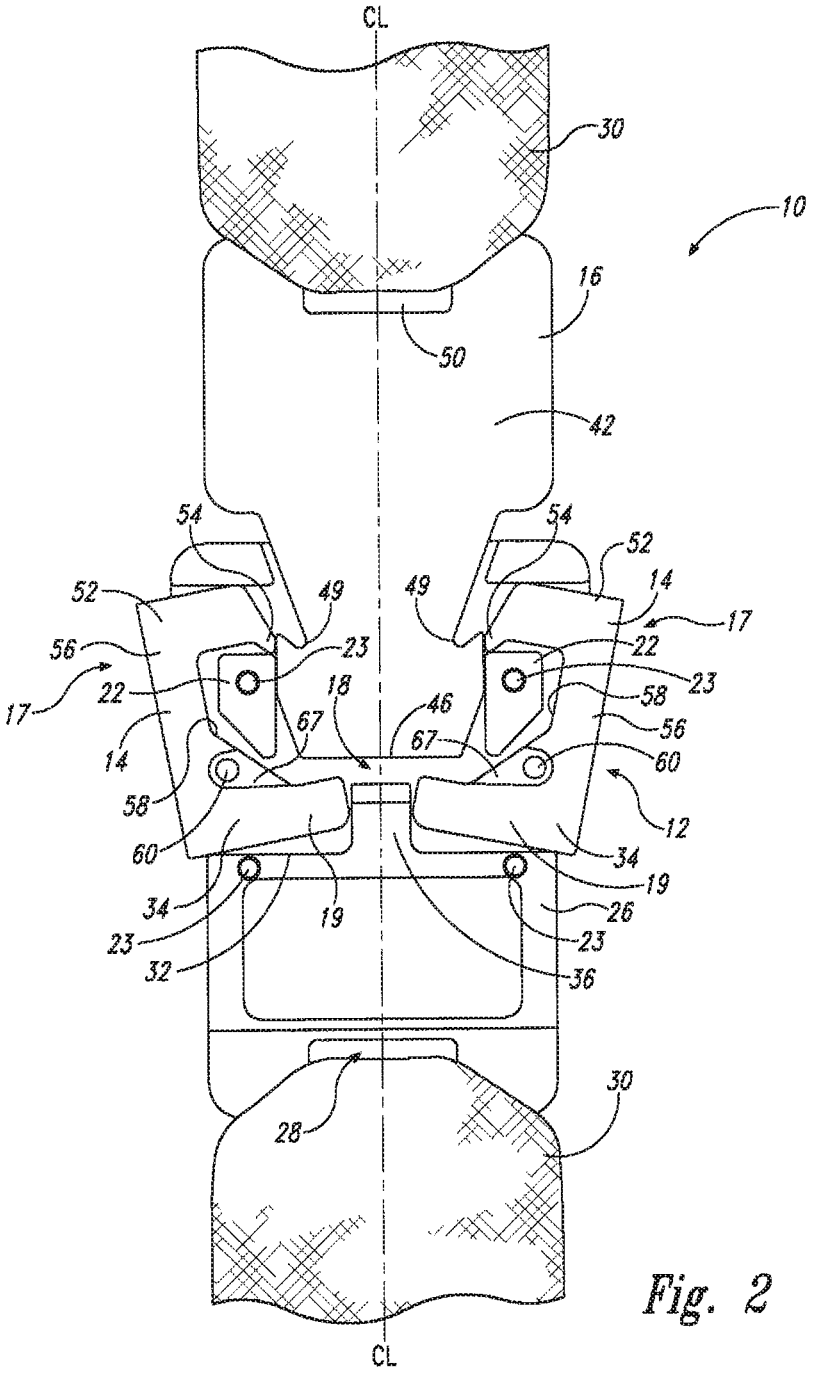
FIG. 2 is a front view of FIG. 1 with the pair of pivotable locking tabs pivoted to release the insert according to an embodiment of the subject matter disclosed herein.
Figure 3:
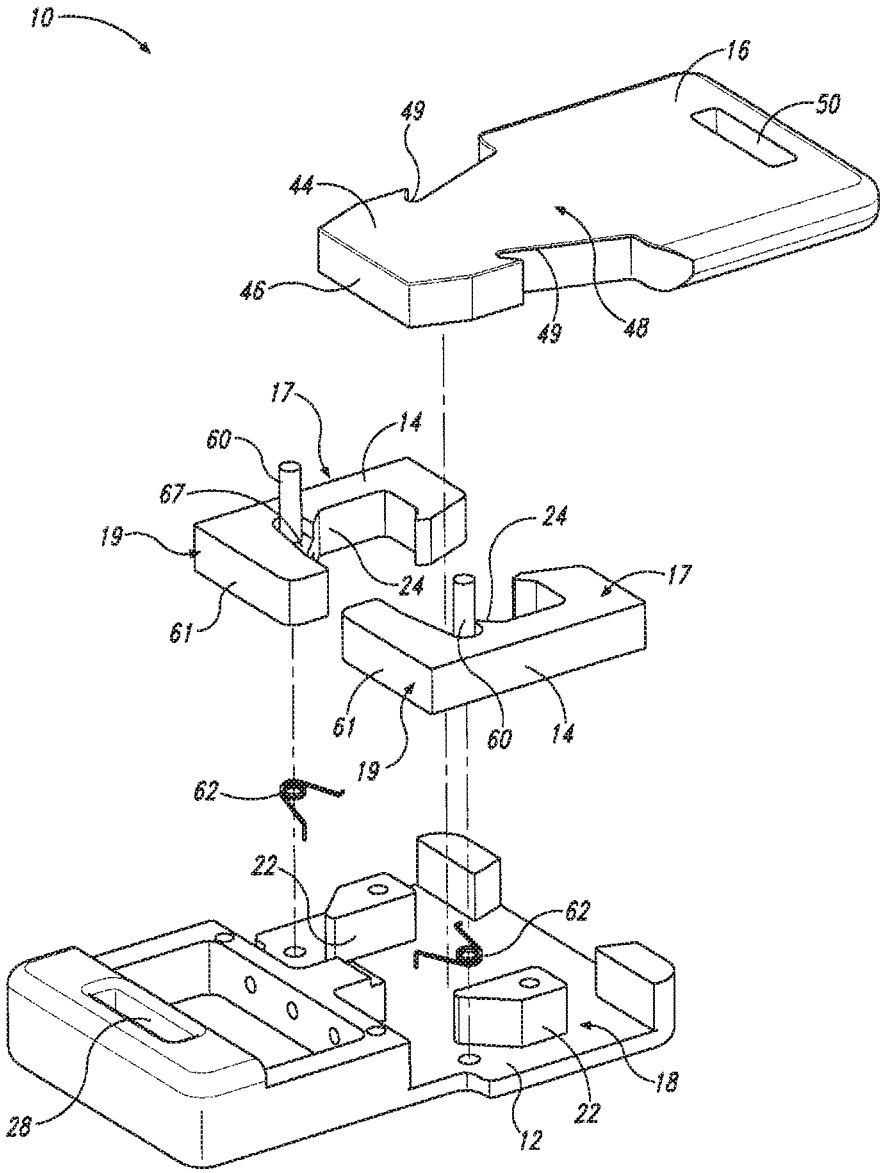
FIG. 3 is an exploded front perspective view like that of FIG. 1 except illustrated rotated 150 degrees and better illustrating a pair of pivot cylinders to which the locking tabs pivot about according to an embodiment of the subject matter disclosed herein.
Figure 4:
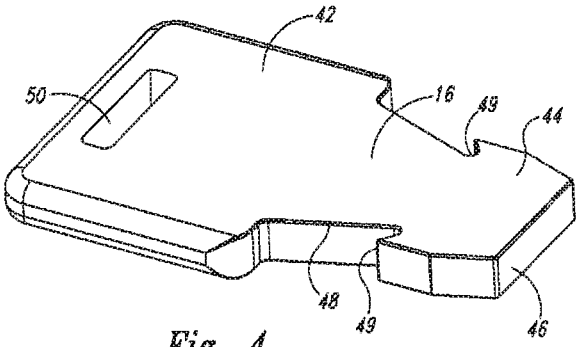
FIG. 4 is a front perspective view of the insert according to an embodiment of the subject matter disclosed herein.
Figure 5:
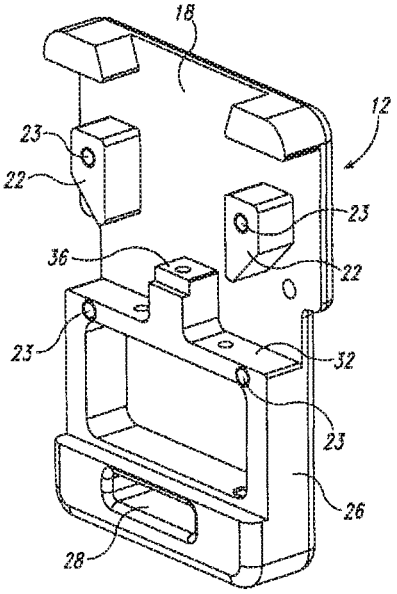
FIG. 5 is a front perspective view of the receiver base according to an embodiment of the subject matter disclosed herein.
Figure 6:
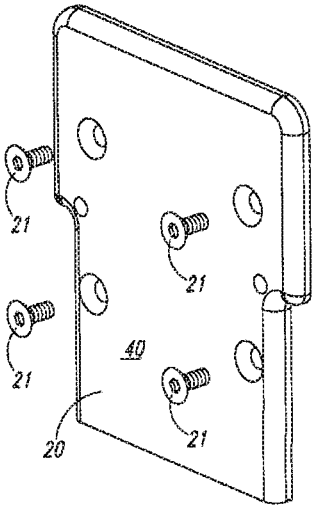
FIG. 6 is a front perspective view of a cover that covers over most of the receiver base when assembled according to an embodiment of the subject matter disclosed herein.

A torsion spring 62 is positioned between the receiver base and each locking tab about cylindrical post 60. Each torsion spring includes a first arm 64 extending from one end of the coiled spring that biases its respective locking tab and a second arm extending from the other end of the coiled spring that biases the adjacent chock 22. The torsion spring for the right side locking tab is the mirror image of the torsion spring for the left side locking tab. The torsion spring allows rotational movement with an indented general arc on the back side of each locking tab about the pivot post (cylindrical post). The same general indented arc 67, but on the front side of the locking tab is illustrated in FIGS. 2 and 3.

Figure 14:
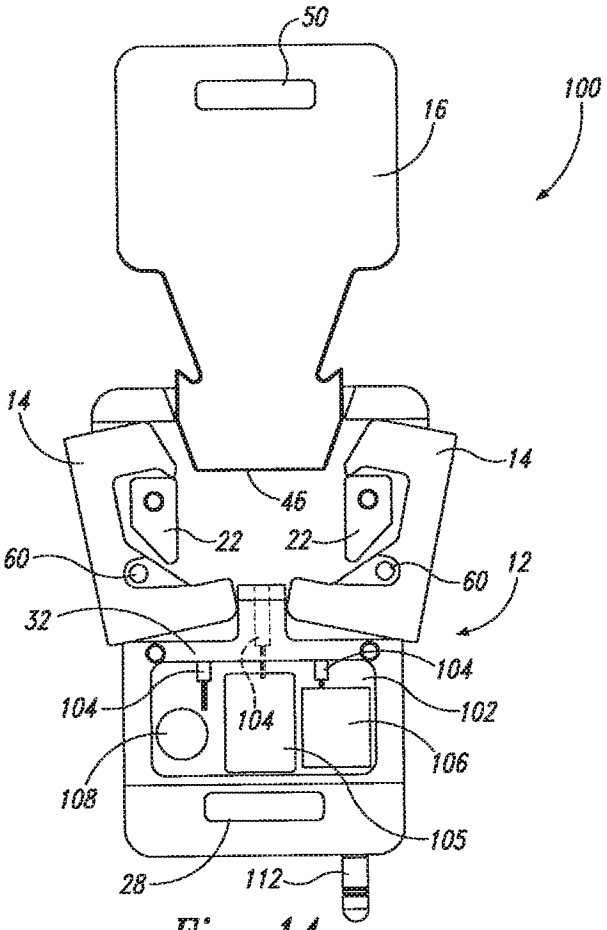
FIG. 14 is a front exploded view of the insert removed from the receiver base and the pivotable locking tabs pivoted to allow release of the insert according to an embodiment of the subject matter disclosed herein.
Figure 13:
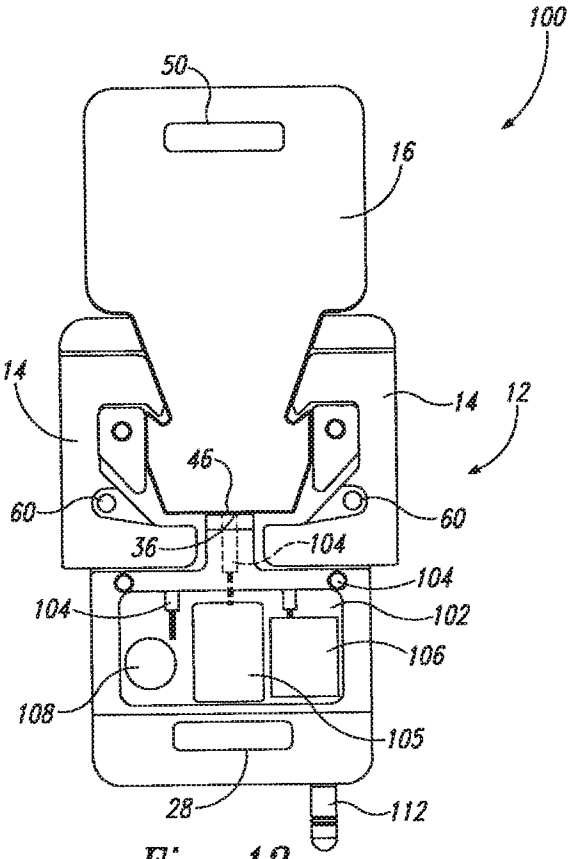
FIG. 13 is a front view of the locking mechanism of FIG. 12 according to an embodiment of the subject matter disclosed herein.
Figure 15:
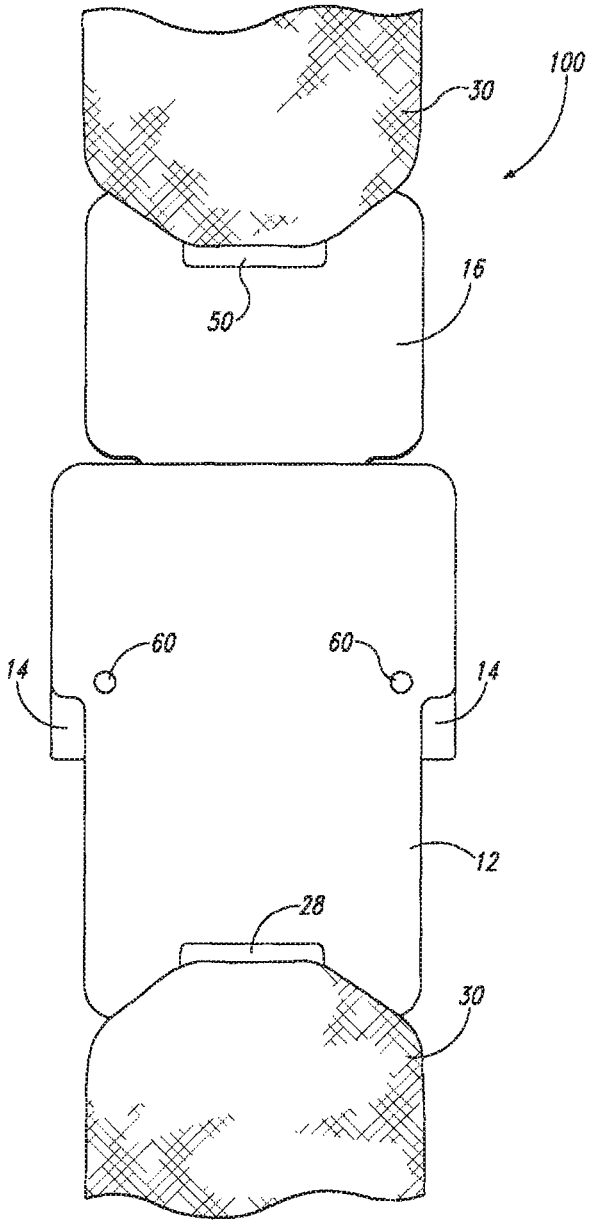
FIG. 15 is a rear view of the receiver base of FIG. 13 according to an embodiment of the subject matter disclosed herein.
Figure 16:
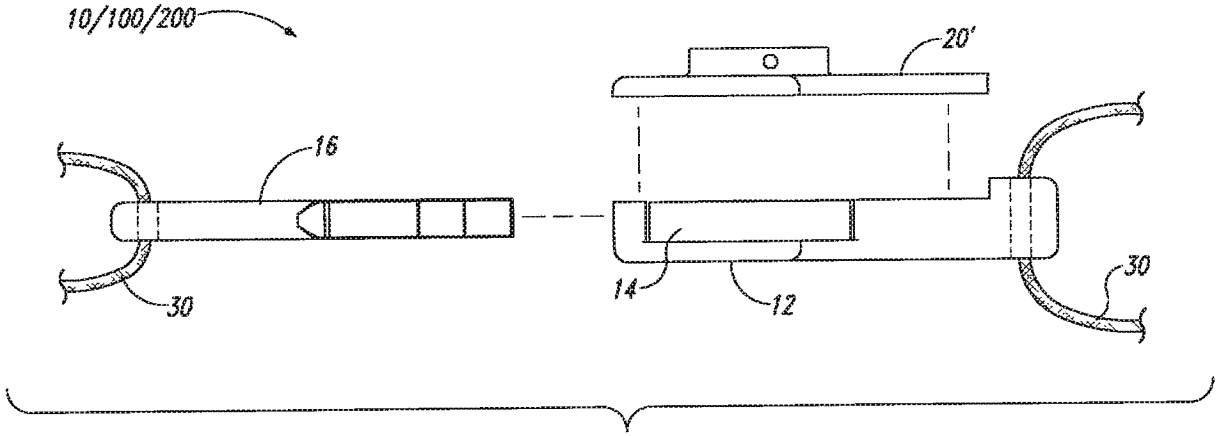
FIG. 16 is an exploded side view of the insert attached to a strap, the receiver base attached to a strap, and the cover.

When the locking mechanism is in the fully locked position (see FIG. 10), the exposed parts are mostly planar, which makes the locking mechanism less likely to get snagged or hooked during use. When the locking mechanism is unlocked, each first arm extends beyond outer edges of the receiver base. The extending first arms past the receiver base (see e.g., FIG. 14) are visible to a worker or third parties. Further, the outer edges of the insert, receiver base, and locking tabs may be chamfered to further reduce the potential of snags or hang ups. Cover 20 may be configured to leave the pivot corner of the locking tab, or at least exterior surface 51 of each locking tab 14, exposed for easy access.

Each top portion of the locking mechanism 52/54 engages one side of the insert projection 44 to retain and hold the insert projection within cavity 18 that is bordered by the receiver base, the chocks, and the first and second arms of each locking tab. To disconnect (unlock) the insert from the cavity, a user applies force on exterior surface 51 located near the pivot point on each locking tab in order to cause rotational movement of each second arm of the locking tab relative to its corresponding first arm of the locking tab. The second arm applies a force on the insert projection leading edge 46 and the first arm no longer engages the sides of insert projection 44. Exterior surface 51 may include knurling or other surface roughening for a worker to more easily engage the point of disconnection on locking tab.

Figure 25:
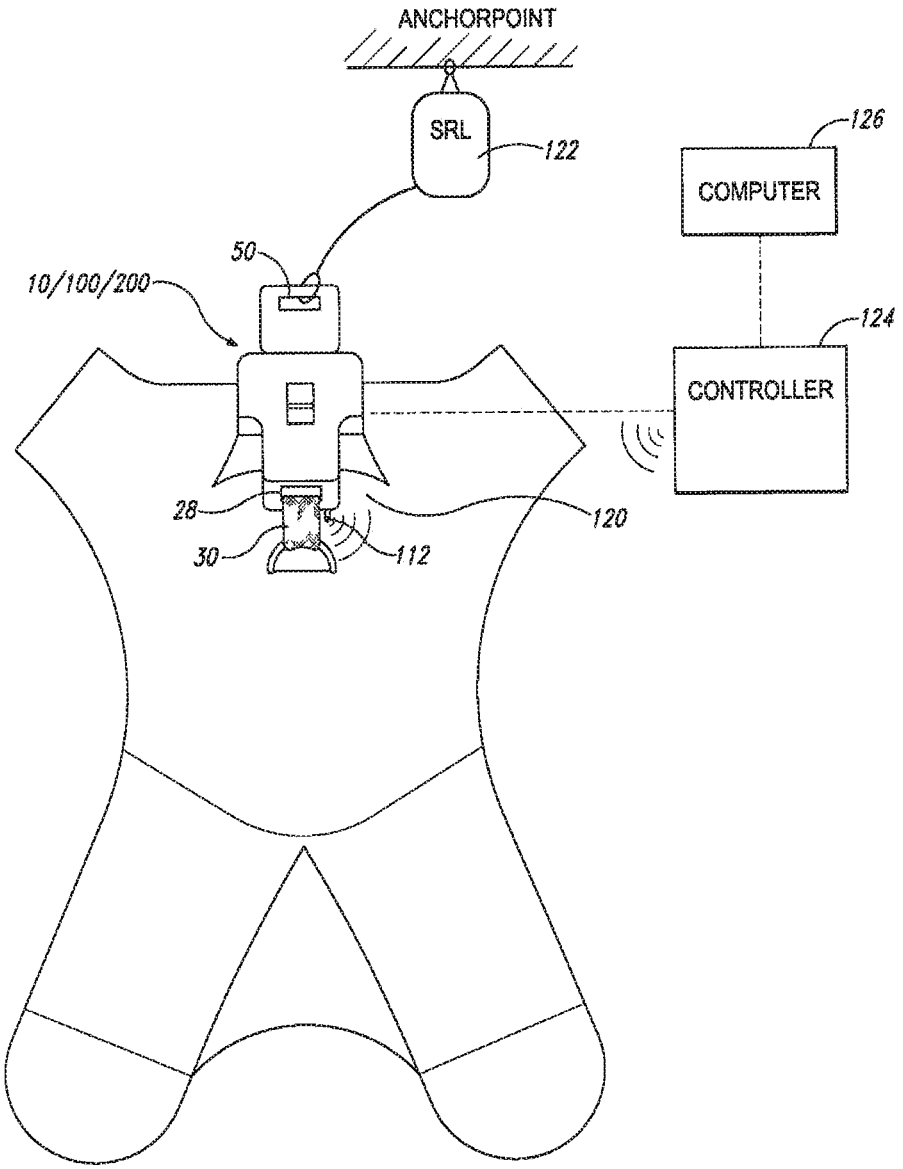
FIG. 25 is a schematic view of the locking mechanism connecting two devices together and electronically connected to a controller for communicating signals to an optional computer when the connection is broken according to an embodiment of the subject matter disclosed herein.

In use, as illustrated in FIG. 25, locking mechanism 10 may be used to connect two devices together through attachment of the two devices to the insert and the receiver base, respectively. Locking mechanism 10 is particularly well suited to joining a first device, such as a safety harness 120 worn by a worker, that includes or is connected to safety straps, webbing, or cable, or some form of connector, where the safety strap, webbing, cable, or connector engages the receiver base, such as through opening 28. The insert, such as through insert opening 50, engages with a second device, such as a retractable lifeline 122, that itself includes or is connected to safety straps, webbing, cable, or connector. Other engagement means can be used such as those illustrated in FIGS. 17 and 18.

Referring now to FIGS. 12-15 and 19, a second embodiment locking mechanism 100 is directed to two-stage locking verification. Similar to locking mechanism 10 above with one-stage mechanical locking, second embodiment 100 includes the same one-stage mechanical locking features above. The same numeral designations are used to describe the second embodiment locking mechanism's mechanical locking functionality. That is that the second embodiment locking mechanism includes a receiver base 12, a pair of locking tabs 14, an insert 16.

However, receiver base 12 also includes an electronic bay 102 that includes various electronic components to verify that insert 16 is fully engaged into cavity 18 and latched by locking tabs 14. The electronic components send a signal to an external device (such as a computer) that determines whether the locking mechanism can open and release the insert through the first locking means.

Figure 19:
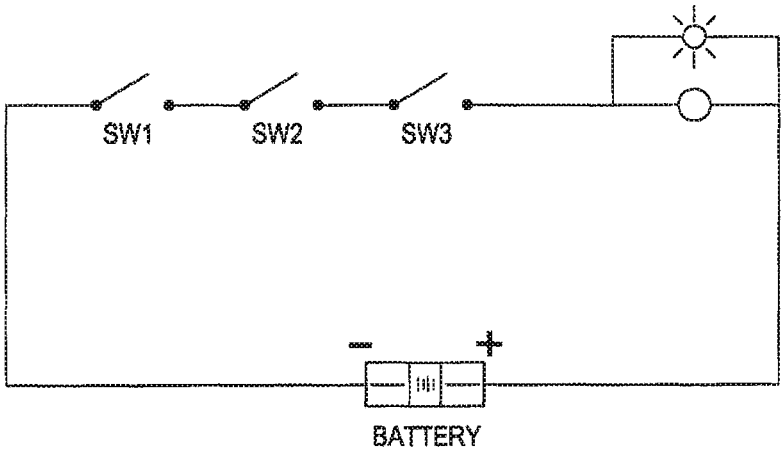
FIG. 19 is a schematic solid state wiring diagram of the electronic components of the harness side Bluetooth board according to an embodiment of the subject matter disclosed herein.
Figure 20:
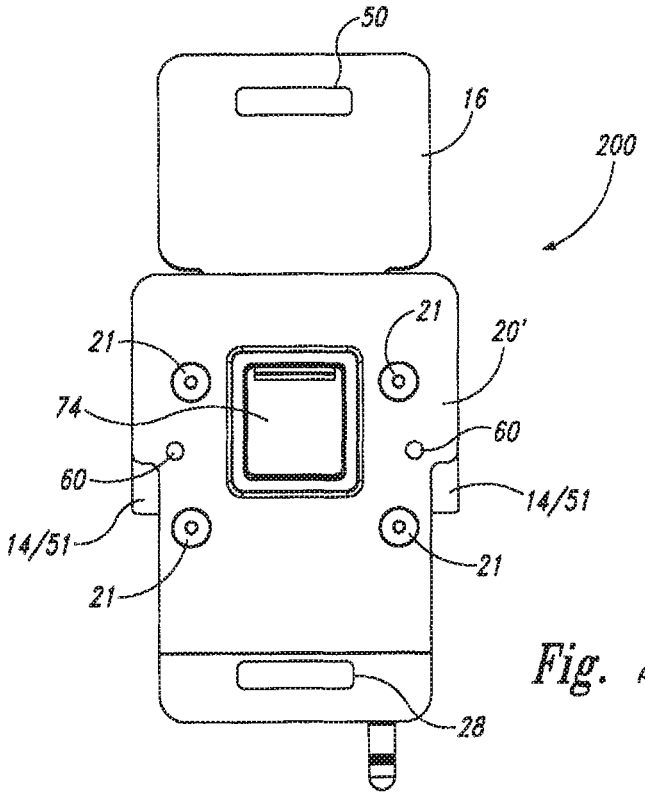
FIG. 20 is a front view of an another alternate embodiment disclosing a secondary or tertiary locking element with an optional press button mechanism according to an embodiment of the subject matter disclosed herein.
Figure 21:
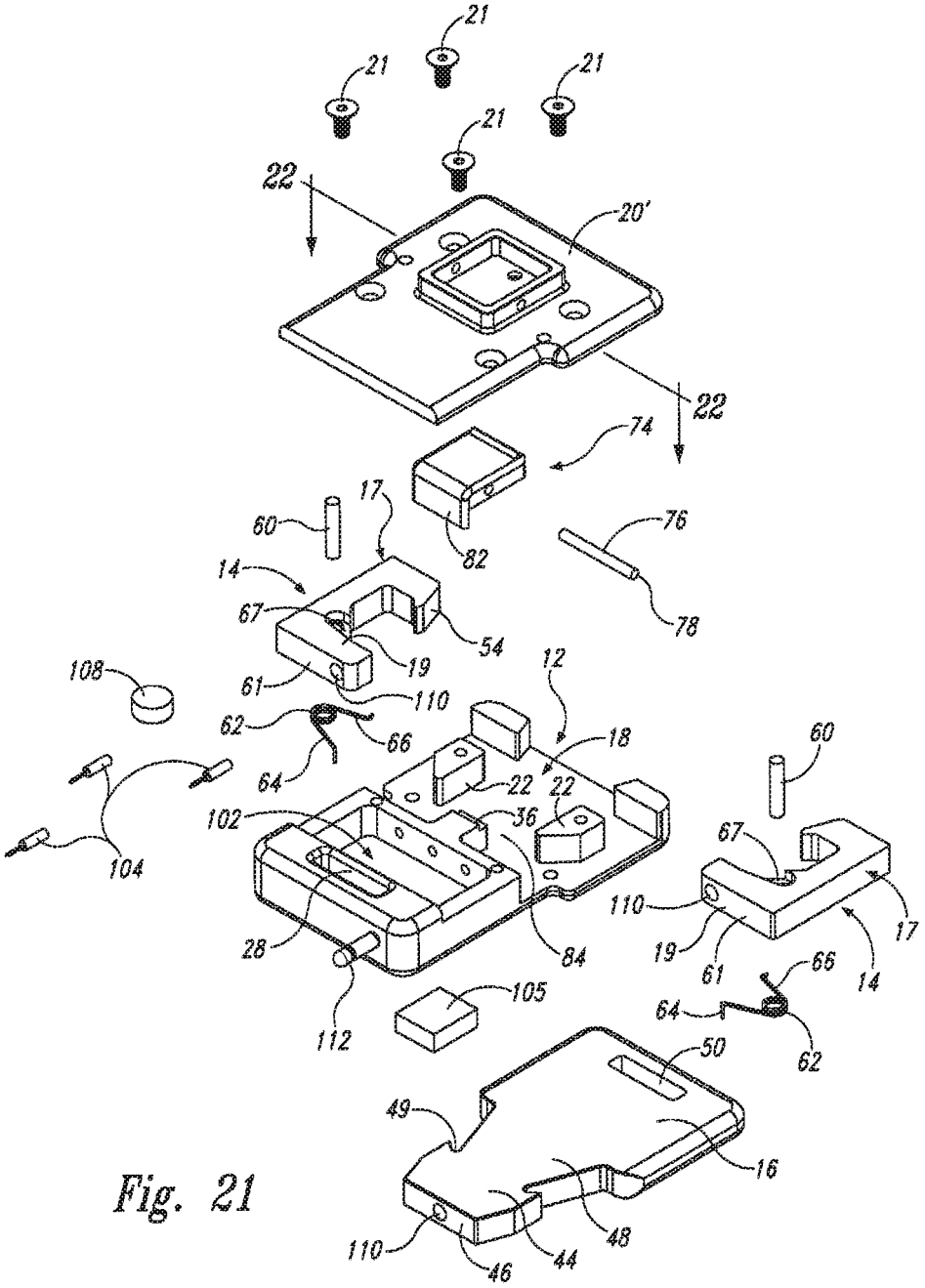
FIG. 21 is an exploded front view of the embodiment of FIG. 20 according to an embodiment of the subject matter disclosed herein.

Referring also to FIG. 19, electronic components may include embedded reed switches 104, a circuit board 105, a relay 106, embedded shielded proximity switches, a pressure switch that has mechanical engagement, an optical sensor, and optional indicator light (e.g., LED light) and a battery 108. These are positioned within the electronic bay 102. There are also magnetic actuators 110, preferably three, to match a corresponding reed switch 104. Magnetic actuators 110 are positioned outside the electronic bay (see for example FIG. 21).

The reed switches 104 may be a Hamlin 59010 Firecracker (3 mm dia., 9 mm long). They will be activated by the magnetic actuators placed in three locations opposite the reed switches. One location will be at the end of the insert, another under the left hand locking tab, and the remaining one under the right hand locking tab. All three switches will normally be in the open position until the magnetic actuator changes their state.

After all three switches are closed by the mechanical action of inserting the insert into the receiver base cavity (one-stage locking), then the electronic components will receive electrical energy from the battery. After the electronic components have communicated via various protocols, such as Bluetooth, near field communication, RFID, Zigbee, or other wireless communication means, that the mechanical (stage one) locking has taken place, a remote computer/processor processes the safe signal, that may be sent via a wireless antenna 112 (see e.g., FIG. 13), received with an aperture 111 within receiver base 12, and will close the dry contacts, such as on a machine interface board (not illustrated). The sensed signal will block electrical signals to an affected machine control function (stage two). Here, in the second stage, the locking mechanism 100, through mechanical closure, triggers a communication between the locking mechanism 100 to a machine (not illustrated) that may be attached to or a controller 124 (see e.g., FIG. 25) that may be interfaced with a machine or multiple machines or to a complete overall monitoring system.

The two-stage locking mechanism with verification capabilities (e.g., remote processor signaling) is particularly useful for dangerous applications where human life (or safety) is at risk or where sensitive expensive equipment is at risk. One application for the two-stage locking mechanism 100 is between a worker in a safety harness 120 and a retractable lifeline 122 where an employer (or construction boss) needs to ascertain with more certainty whether it is safe for a worker to detach from a lifeline. The connection or disconnection can be signaled to a controller 124, which can be forwarded to a computer device 126 that can be networked with an internal or external safety monitor command center (not illustrated). Further, the locking mechanism (10 or 100) allows a worker to remove him or herself from a lifeline without removing the worker's safety harness.

Figure 18:
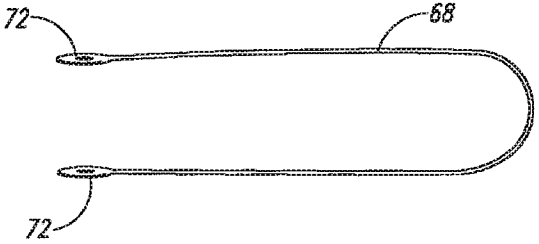
FIG. 18 is a schematic view of a cable that may be received by the alternate attachment means disclosed in FIG. 17 according to an embodiment of the subject matter disclosed herein.
Figure 17:
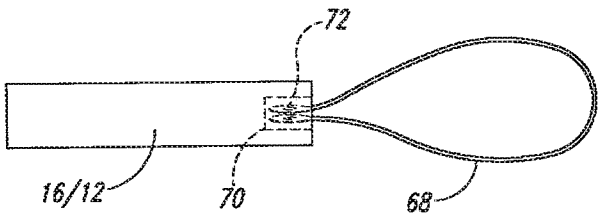
FIG. 17 is a schematic view of an alternate strap attachment means according to an embodiment of the subject matter disclosed herein.

FIGS. 17 and 18 illustrate a different means for engaging a cable 68 or strap. Instead of a safety strap being threaded between openings 28 and 50 of the receiver base and insert, respectively, the cable or strap ends are captured within an opening 70 that opens through the outer edge of the receiver base and/or insert as illustrated in FIG. 17. Cable or strap 68 includes flexible expanding end portions 72 that can be inserted into opening 70 but cannot come out without cutting the cable/strap. Alternatively, cable ends can be epoxied or other permanent fastening means within opening 70.

FIGS. 20-24 disclose another alternate embodiment locking mechanism 200 with either secondary or tertiary locking verification means. Locking mechanism 200 can be used in connection with the one-stage locking verification means found in locking mechanism 10 or used with locking mechanism 100 (two-stage locking verification means), depending on the type of application that is desired. Locking mechanism 200 contains a receiver base 12, a pair of locking tabs 14, and an insert 16 all like those elements described in detail above. Cover 20' however is different from cover 20 in that it is adapted to accommodate a centrally positioned push button mechanism 74.

Push button mechanism 74 includes a centrally positioned rod 76 that extends past the confines of a mechanism housing 75 to form ends 78. The mechanism housing is operably connected to a spring 80 that is biased against the interior of the receiver base.

Figure 22:
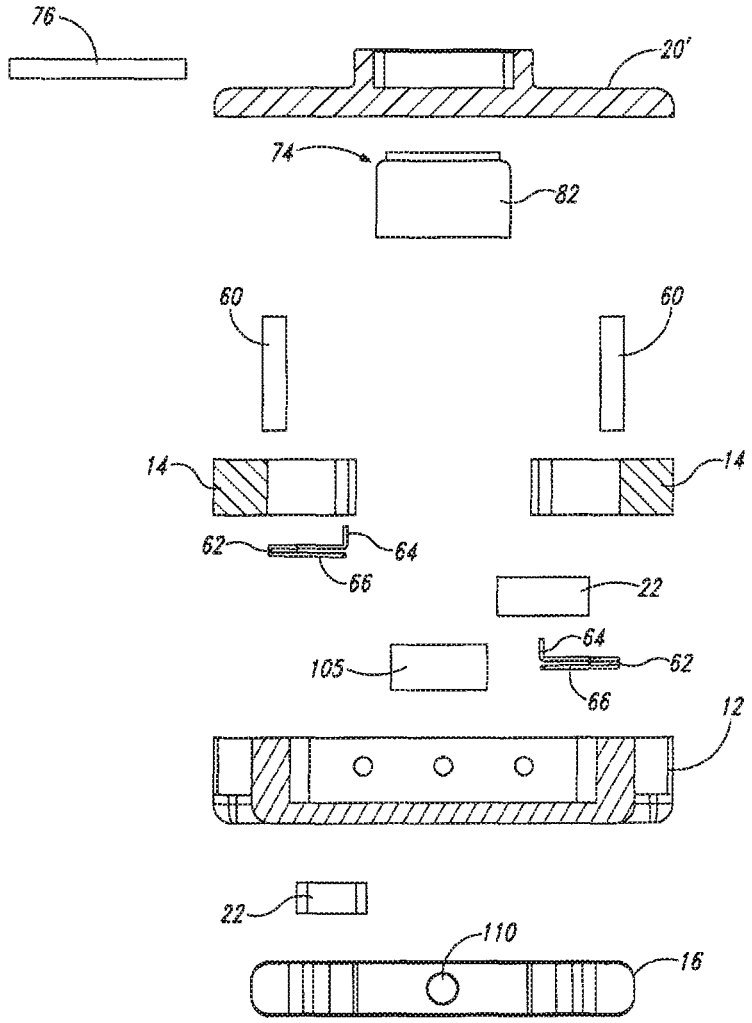
FIG. 22 is a bottom exploded view of the embodiment of FIG. 20 according to an embodiment of the subject matter disclosed herein.
Figure 23:
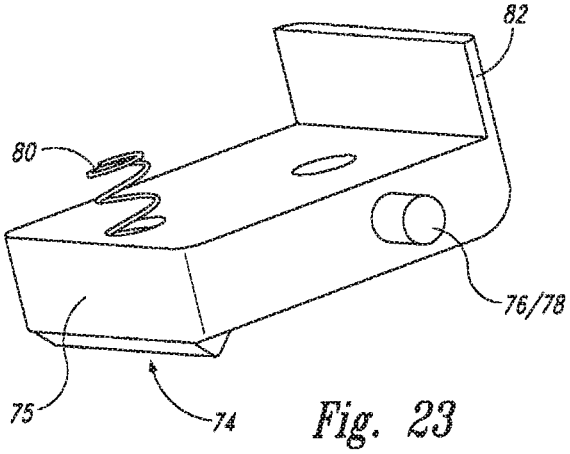
FIG. 23 is an enlarged bottom perspective view of the press button mechanism of FIG. 20 according to an embodiment of the subject matter disclosed herein.
Figure 24:
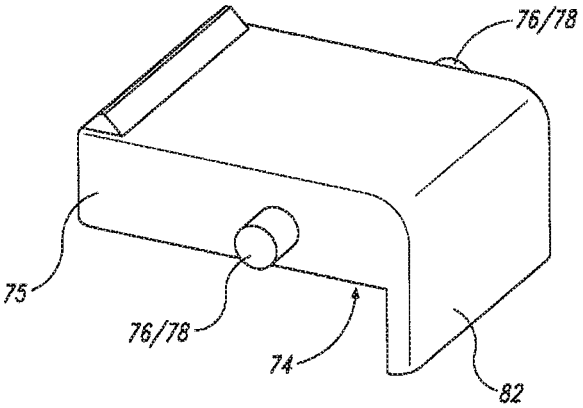
FIG. 24 is an enlarged top perspective view of the press button mechanism of FIG. 20 according to an embodiment of the subject matter disclosed herein.

During locking action, a lower lip 82 extends from mechanism housing 75 that engages with a slot or indent within the receiver base 84, such as on central abutment member 36, (FIG. 22). Lower lip 82 also is positioned directly above upper surface 59 of each locking tab lower arm. The physical relationship between the lower lip 82 and the locking tab lower arms, which may be touching but does not need to be, keeps the locking tabs from rotational movement until the button retracts the lower lip and the two locking tabs are rotated to disengage the insert projection from the cavity.

Torsion springs 62, as discussed above, may be embedded under each locking tab to keep inward tension of the locking tabs. The torsion springs mount around a respective cylindrical post (or pivot pin) to tension the spring with regard to its corresponding locking tab so that a user would need to squeeze them with approximately 5 lbs of pressure in order to release (pivot) the locking tabs.

When pressing the push button mechanism 74, it retracts the lower lip 82 and, therefore, disengages with the indent or slot 84 in receiver base 12 and no longer stops the lower arms of the locking tabs from rotation (and displacement of the leading edge of the insert). Then a user may squeeze on the two locking tabs at the same time as the push button is depressed to effectuate three point mechanical unlocking of the locking mechanism 10.

If used with the locking mechanism 100, the push button mechanism 74 along with the pivotable locking tabs act as a tertiary locking action to the two-stage locking verification means described to locking mechanism 100 (mechanical locking of the insert in the first stage, and electronic locking means of the second stage). In this embodiment, the push button must be depressed at the same time as depressing the locking tabs in order to pivot the locking tabs to disconnect (unlock) the insert from the locking tabs and receiver base cavity. The push button and two locking tabs form a three point contact before locking or unlocking can take place.

The locking mechanisms 10, 100, 200 may be made of metal or man-made materials. In one form, locking mechanisms 10, 100, and 200 are made of aluminum. In another form they are made from carbon fiber as a strong, yet lightweight, alternative.

Figure 26:
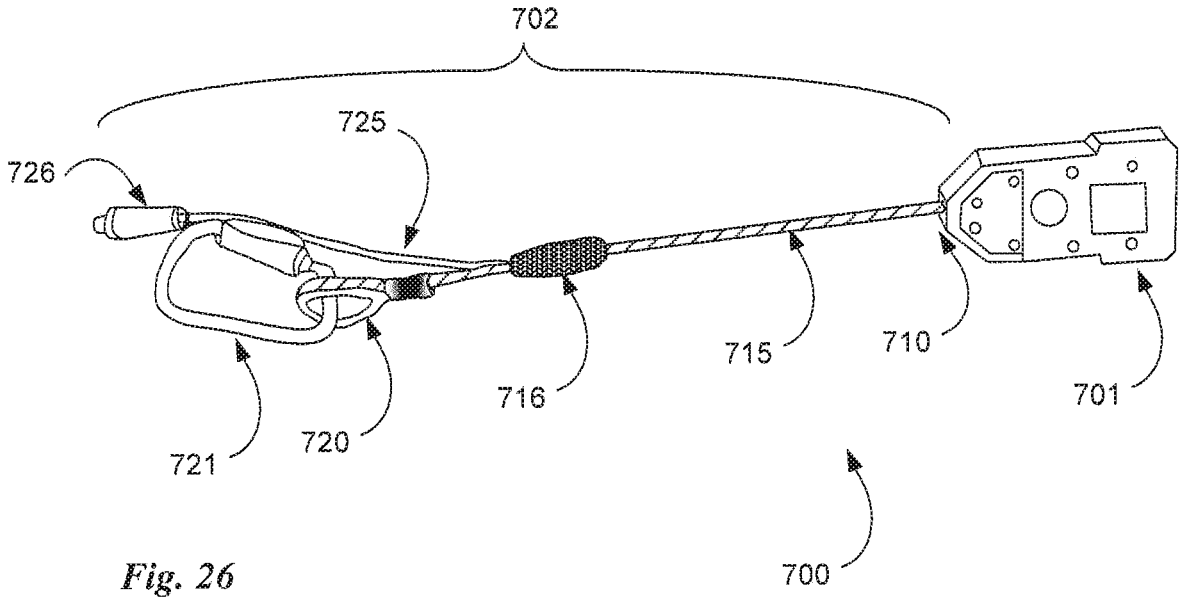
FIG. 26 is a perspective view of a locking mechanism system having a steel cable harness attached thereto according to an embodiment of the subject matter disclosed herein.
Figure 27:
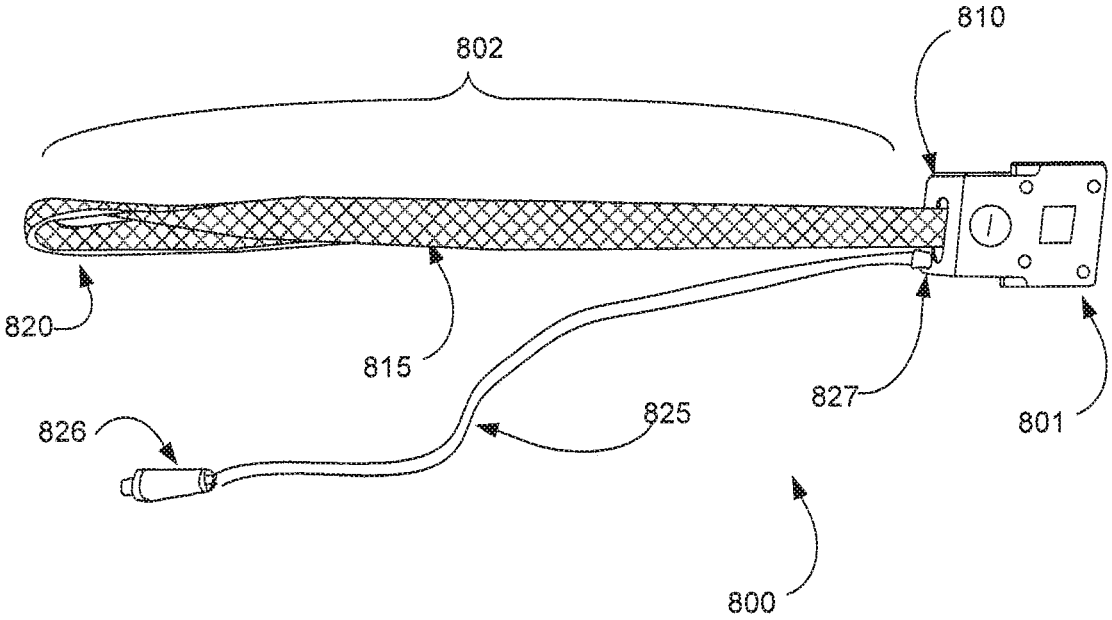
FIG. 27 is a perspective view of a locking mechanism system having a nylon webbing harness attached thereto according to an embodiment of the subject matter disclosed herein.
Figure 28:
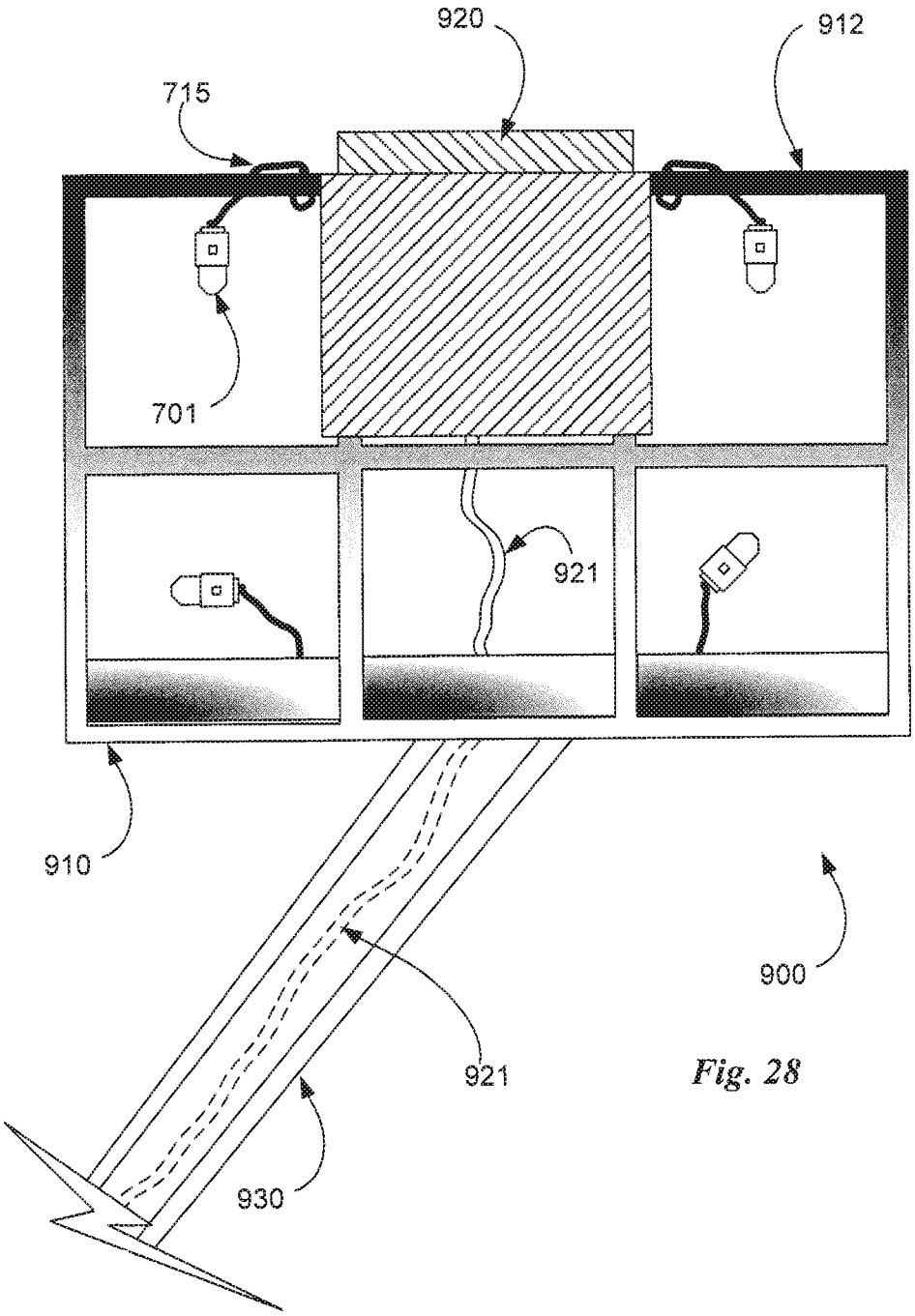
FIG. 28 is a system view of a human lift device that utilizes one or more of the locking mechanism systems from FIG. 26 or 27 according to an embodiment of the subject matter disclosed herein.

FIGS. 26-28 show additional embodiments that take advantage of remote signal processing for determining the status of the locking mechanisms via communications signals that are transmitted and received through an attached cable. In various embodiments discussed above, electronic circuitry may be used to determine whether specific locking points have been perfected, thereby ensuring the locking mechanism is properly secured. In the embodiment that follow, the various electronic circuitry may further receive power and be in communication with at attached umbilical cord that may or may not be part of an overall harness system.

FIG. 26 is a perspective view of a locking mechanism system 700 having a steel rope harness 702 attached to a locking mechanism 701 according to an embodiment of the subject matter disclosed herein. As used herein, the harness 702 refers to the attachment assembly or linking member that may be coupled to the locking mechanism 701 on one end as well as attached to an anchor point (e.g.; a railing of a human lift system) at some location remote form the locking mechanism 701. The harness 702, as used herein includes the components of FIG. 26 except for the locking mechanism 701 itself. Further, the locking mechanism 701 mat be any one of the embodiments described previously, e.g., locking mechanisms 10, 100 and 200. As such, the harness 702, in this embodiment, includes a steel rope 715 that is removably coupled to an assembly attachment point 710 on the locking mechanism 701. In other embodiments, this coupling may be permanent and integral with the locking mechanism 701.

The harness 702 may further include a means for attaching the harness to an anchor point, such as a railing of a human lift system, railing of scaffolding, or wall or roof of a building. In this embodiment, the steel rope 715 culminates in a loop 720 that may be engaged with a carabineer 721. A skilled artisan understands that any means of attachment or anchoring may be realized and that the length of the steel rope 715 may be longer than depicted in FIG. 26. Together, the harness 702 and the locking mechanism 701 completes the locking mechanism system 700 such that a person who engages the locking mechanism system may be protected from falls from high places, such as a scaffolding (not shown) or human lift device (not shown).

The harness may further include a signal cable 725 that culminates in a connector 726. The signal cable 725 may be disposed inside the steel rope 715 for a sizable length of the harness 702. The steel rope 715 may include an exit point 716 for the signal cable 725 to no longer be disposed within the steel rope 715. In this manner, the signal cable 725 is protected inside the steel rope 715 portion of the harness 702 so that the signal cable 725 will avoid being pulled the way that the steel rope 715 may be pulled when preventing accidentals falls and the like. That is, the steel rope 715 will provide tensile strength for the harness 702 and will avoid breaking or otherwise compromising the signal cable 725 as it is protected inside the steel rope 715. In this manner, signals may be transmitted to and from the locking mechanism 701 to the signal cable connector 726.

The signal cable connector 726 is configured to be interfaced with some manner of control system or monitor system (e.g., local or remote controller) that is remote from the locking mechanism 701. Thus, the remote monitor system (not shown) may provide one or more power signals to the locking mechanism 701 for powering various onboard circuitry. Further, or even alternatively, the remote system may deliver low-power control signals or monitor signals that are used to determine of the various switches disposed in the locking mechanism indicate that the locking mechanism is properly engaged with an inserted device, thereby ensuring that the overall locking mechanism system is properly engaged. Thus, a monitor circuit may include a signal source located remotely (with respect to the locking mechanism 701) that may send a signal to the indicator switches inside the locking mechanism (two or three, depending on the embodiment as discussed previously). If each of the indicator switches in the series in a closed state, then the circuit is "made up" and the remote system receives the return signal indicating that the locking mechanism 701 is properly engaged. If the signal is not returned and the circuit remains open due to one or more indicator switches remaining open, then the remote system determines that the insert device is improperly engaged.

FIG. 27 is a perspective view of a locking mechanism system 800 having a nylon webbing harness 802 attached to a locking mechanism 801 according to an embodiment of the subject matter disclosed herein. As used previously, the harness 802 refers to the attachment assembly that may be coupled to the locking mechanism 801 on one end as well as attached to an anchor point (e.g., a railing of a human lift system) at some location remote from the locking mechanism 801. Further, the locking mechanism 801 mat be any one of the embodiments described previously, e.g., locking mechanisms 10, 100 and 200. As such, the harness 802, in this embodiment, includes a woven nylon member 815 that is removably coupled to an assembly attachment point 810 on the locking mechanism 801.

The harness 802 may further include a means for attaching the harness to an anchor point, such as a railing of a human lift system, railing of scaffolding, or wall or roof of a building. In this embodiment, the woven nylon member 815 culminates in a loop 816. A skilled artisan understands that any means of attachment or anchoring may be realized and that the length of the woven nylon member 815 may be longer than depicted in FIG. 27. Together, the harness 802 and the locking mechanism 801 completes the locking mechanism system 800 such that a person who engages the locking mechanism system 800 may be protected from falls from high places, such as a scaffolding (not shown) or human lift device (not shown).

The harness 802 may further include a signal cable 825 that culminates in a connector 826. The signal cable 825 may be disposed along side the woven nylon member 815 for the entire length of the harness 802 with a little bit of length to spare when compared to the length of the woven nylon member 815. In this manner, the signal cable 825 is protected by the woven nylon member 815 portion of the harness 802 because the signal cable 825 will avoid being pulled the way that the woven nylon member 815 may be pulled when preventing accidentals falls and the like. That is, the woven nylon member 815 will provide tensile strength for the harness 802 and will avoid breaking or otherwise compromising the signal cable 825. In this manner, signals may be transmitted to and from the locking mechanism 801 to the signal cable connector 82 through a signal cable port 827. The signal cable connector 826 operates in a similar manner to the signal cable 825/signal connector 826 tandem as discussed above with respect to FIG. 26.

FIG. 28 is a system view of a human lift device 900 that utilizes one or more of the locking mechanism systems from FIG. 26 or 27 according to an embodiment of the subject matter disclosed herein. In this embodiment, e.g., the system 900 includes a basket 910 or personnel workspace that may be lifted into the air from a lift mechanism (not shown) via a boom arm 930. In this manner, a worker may be lifted to a work area. For safety, the worker will latch into one or more locking mechanisms 701. In FIG. 28, four locking mechanisms 701 along with four respective steel ropes 715 are shown. The basket includes safety railing to assist with keeping workers safely in the workspace. As such, the steel ropes 715 may be anchored to the one or more railings or one or more secure and stationary portions of the basket 910.

These embodiments of the locking mechanisms 701 may include a signal cable 725 disposed inside the steel ropes 715 such that the signal cable 725 may attach to a local controller 920. In this manner, the local controls may be locked out until one or more of the locking mechanisms indicate a proper latch with an insert device (that is coupled with a worker such as a 5-point safety harness or safety suit (not shown)). In other embodiments, each signal cable joins a larger signal cable run 921 that connects to a remote controller at the other end of the boom arm 930. As such, the remote controller may similarly be locked out of operation until one or more locking mechanisms 701 indicate correct insertion with a safety device. The overall system 900 is further understood with respect to the system block diagram of FIG. 29.

Figure 29:
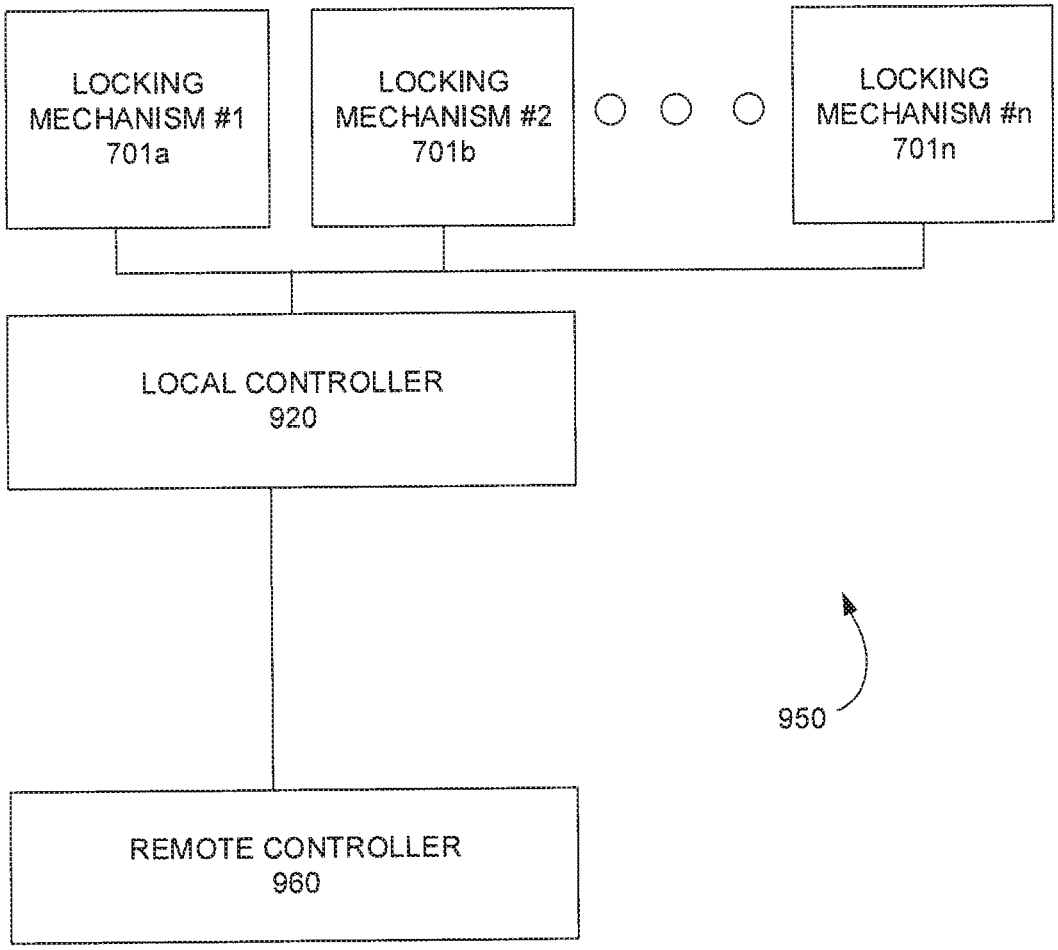
FIG. 29 is a block diagram of the human lift device system of FIG. 28 according to an embodiment of the subject matter disclosed herein.

FIG. 29 is a block diagram 950 of the human lift device system of FIG. 28 according to an embodiment of the subject matter disclosed herein. The system includes one or more locking mechanisms 701*a*, 701*b*, - - - 701*n*. Each respective locking mechanism may be communicatively coupled to a local controller 920. In this manner, the local controller 920 is configured to send a signal to each locking mechanism. If each indicator switch is closed (indicative of an insert device properly engaged with the locking mechanism), then a return signal is sensed through a series circuit that is completed. The local controller 920 may be configured to be locked out if none of the locking mechanisms 701*a*, 701*b*, - - - 701*n* indicate being properly engaged. In other embodiments, the local controller 920 may be locked out is any one of the locking mechanisms 701*a*, 701*b*, - - - 701*n* does not indicate a complete signal circuit.

Further, each respective locking mechanism 701*a*, 701*b*, - - - 701*n* may be communicatively coupled to a remote controller 960. In this manner, the remote controller 960 is also configured to send a signal to each locking mechanism. If each indicator switch is closed (indicative of an insert device properly engaged with the locking mechanism), then a return signal is sensed through a series circuit that is completed. The remote controller 960 may be configured to be locked out if none of the locking mechanisms 701*a*, 701*b*, - - - 701*n* indicate being properly engaged. In other embodiments, the remote controller 960 may be locked out is any one of the locking mechanisms 701*a*, 701*b*, - - - 701*n* does not indicate a complete signal circuit. With a remote controller 960, the signals may be routed through the local controller 920 such that both the remote controller 960 and the local controller 920 are enabled or locked out in unison.

It is to be understood that many changes in the particular structure, materials, and features described herein may be made without departing from the spirit and scope of the subject matter. Therefore it is the Applicant's intention that its patent rights not be limited by the particular embodiments illustrated and described herein, but rather by the following claims interpreted according to accepted doctrines of claim interpretation, including the Doctrine of Equivalents and Reversal of Parts.

What is claimed is:

1. A locking mechanism comprising:

a receiver base having a plurality of locking components configured to securely engage a device, at least two of the plurality of locking components including a locking tab configured to pivot about a respective pin operatively coupled to the receiver base, each locking tab having a first arm and a second arm, the receiver base further including an indicator configured to indicate that a respective locking component is secured with the device;

a linking member coupled to the receiver base, the linking member configured to link the locking mechanism with an anchor point; and a signal wire coupled to the receiver base and configured to communicate a signal corresponding to the indicator.

2. The locking mechanism of claim 1, wherein the receiver base further comprises an upper portion and a lower portion, and wherein a cavity configured to receive the device is formed between the two locking tabs and the upper portion of the receiver base.

3. The locking mechanism of claim 1, wherein the linking member comprises a steel rope.

4. The locking mechanism of claim 1, wherein the linking member comprises woven nylon.

5. The locking mechanism of claim 1, wherein the signal wire is disposed in the linking member.

6. The locking mechanism of claim 1, wherein the plurality of locking components comprises three locking components, each locking component including a respective electrical switch configured to indicate when the device is secured with the locking component, wherein the electrical switches are communicatively coupled to the signal wire.

7. The locking mechanism of claim 1, wherein the plurality of locking components comprises three locking components, each locking component including a respective reed switch configured to indicate when the device is secured with the locking component, wherein the reed switches are communicatively coupled to the signal wire.

8. A human lift system, comprising:

a workspace having a local controller for maneuvering the workspace;

an anchor point disposed in the workspace;

a locking mechanism including:

a receiver base having a plurality of locking components configured to securely engage a device, at least one of the plurality of locking components including an indicator configured to indicate that a respective locking mechanism is secured with the device and a pair of locking tabs configured to pivot about a respective pin operatively coupled to the receiver base;

a linking member coupled to the receiver base coupled to the anchor point; and a signal wire coupled to the receiver base and configured to communicate a signal to the local controller that corresponds to the indicator.

9. The human lift system of claim 8, wherein the workspace further comprises a basket for lifting one or more workers to a work location and the anchor point further comprises a basket railing.

10. The human lift system of claim 8, further comprising a plurality of locking mechanisms each having a receiver base coupled to one of a respective plurality of anchor points disposed in the workspace.

11. The human lift system of claim 8, wherein the signal cable is disposed in the linking member and is communicatively coupled to the local controller.

12. The human lift system of claim 8, wherein the local controller is locked out of operation if the signal communicated to the local controller from the indicator indicates that the locking mechanism is improperly engaged.

13. The human lift system of claim 8, further comprising a mobile base having a remote controller for the workspace, the remote controller further configured to be locked out of operation if the signal communicated to the local controller from the indicator indicates that the locking mechanism is improperly engaged.

14. The human lift system of claim 8, further comprising a human safety harness having an insert configured with a leading edge and an upper portion, the lower portion of the insert configured to be received by the receiver base of the locking mechanism.

15. The human lift system of claim 8, further comprising a plurality of locking mechanisms wherein the local controller is locked out of operation if any one of the plurality of locking mechanisms indicates an improperly engaged insert device.

16. The human lift system of claim 8, further comprising a plurality of locking mechanisms wherein the local controller is locked out of operation if each of the plurality of locking mechanisms indicates an improperly engaged insert device.

17. A method for providing safety to a worker, the method comprising:

in a human lift device, inserting a personal safety harness device into locking mechanism having a linking member attached to an anchor point of the human lift device and having a receiver base with a plurality of locking components including a pair of locking tabs configured to pivot about a respective pin operatively coupled to the receiver base, sensing whether or not a plurality of indicator switches indicate that the personal safety harness device is properly engaged with the locking mechanism through the linking member; and disengaging a local controller if any one indicator switch in the locking mechanism indicates that the personal safety harness device is improperly engaged with the locking mechanism.

18. The method of claim 17, further comprising enabling the local controller if each indicator switch indicates that the personal safety harness device is properly engaged with the locking mechanism.

19. The method of claim 17, further comprising disengaging a remote controller if any one indicator switch in the locking mechanism indicates that the personal safety harness device is improperly engaged with the locking mechanism.

* * * * *